US006841731B1

(12) United States Patent
Zanello

(10) Patent No.: US 6,841,731 B1
(45) Date of Patent: Jan. 11, 2005

(54) TERMINAL ASSEMBLY

(75) Inventor: Jim Zanello, Plaistow, NH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/739,570

(22) Filed: Dec. 18, 2003

(51) Int. Cl.[7] ..... H01J 5/00

(52) U.S. Cl. ..... 174/50.56; 174/50.57; 174/50.6; 439/935

(58) Field of Search ..... 174/50.56, 50.57, 174/50.63, 50.6, 135; 429/181; 439/935, 926

(56) References Cited

U.S. PATENT DOCUMENTS 3,160,460 A 12/1964 Wyzenbeek
4,308,323 A 12/1981 Bowsky
4,362,792 A 12/1982 Bowsky et al.
4,786,762 A 11/1988 Bowsky et al.
5,861,577 A * 1/1999 Tamura et al. ..... 174/50.56
6,111,198 A * 8/2000 Tower ..... 174/50.56
6,137,053 A * 10/2000 Andou et al. ..... 174/50.56
6,245,993 B1 * 6/2001 Franey et al. ..... 174/50.56

* cited by examiner

*Primary Examiner*—Dhiru R. Patel
(74) *Attorney, Agent, or Firm*—Harness, Dickey & Pierce, PLC

(57) ABSTRACT

A terminal assembly and terminal installation. In one embodiment, the terminal assembly includes a body having a longitudinal opening therethrough and a shoulder. The terminal assembly is installed in an aperture adapted to receive and join the body to a wall with a joining process material. The terminal assembly includes a current-conducting pin extending longitudinally through the opening in the body, and a dielectric seal between the body and the pin. The shoulder of the body is configured to prevent the migration of debris toward the pin during installation.

13 Claims, 2 Drawing Sheets

TERMINAL ASSEMBLY

FIELD OF THE INVENTION

The present invention relates to a terminal installation and a terminal assembly.

BACKGROUND OF THE INVENTION

Installations of low power terminal assemblies are well known in the art. Terminal assemblies, such as the prior art assembly illustrated in FIG. 1, typically include one or more current-conducting pins 5 that are secured to a metallic body 7 by a glass-to-metal seal 9. The body 7 is installed and sealed into an opening 6 defined in a wall 3.

A durable seal between the body and the opening in the wall is desirable to maintain the integrity of the feed-through under elevated stress and temperature conditions without causing breakage between the body and the opening in the wall. It is also important to provide an optimum air path between adjacent portions of the conductive pin and the opening in the wall in order for the conductive pin to be operably coupled with an external device.

On occasion, the conductive pins of prior art terminal assemblies, such as the one illustrated in FIG. 1, become contaminated during installation, when the body 7 is soldered or otherwise secured into the opening 6 of the wall 3. Specifically, as solder fills the opening 6 between the body 7 and the wall 3, an overflow of solder or other joining process material may leave the opening 6 in an arc-like manner coming in contact with portions of the conductive pin 5.

There is a need for a terminal assembly that eliminates the potential of contamination of the conductive pin during installation.

SUMMARY OF THE INVENTION

The invention provides a terminal installation and a terminal assembly. In one embodiment, the terminal assembly includes a body that has a longitudinal opening and a shoulder. The terminal assembly is installed in an aperture adapted to receive and join the body to a wall with a joining process material. The terminal assembly includes a current-conducting pin that extends longitudinally through the opening in the body, and a dielectric seal between the body and the pin. The shoulder of the body is configured to prevent the migration of debris, such as an overflow of joining process material, toward the pin during installation of the terminal assembly.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF PREFERRED EMBODIMENTS

The following description of the preferred embodiments is merely exemplary in nature and is in no way intended to limit the invention, its application, or uses.

Figure 1:
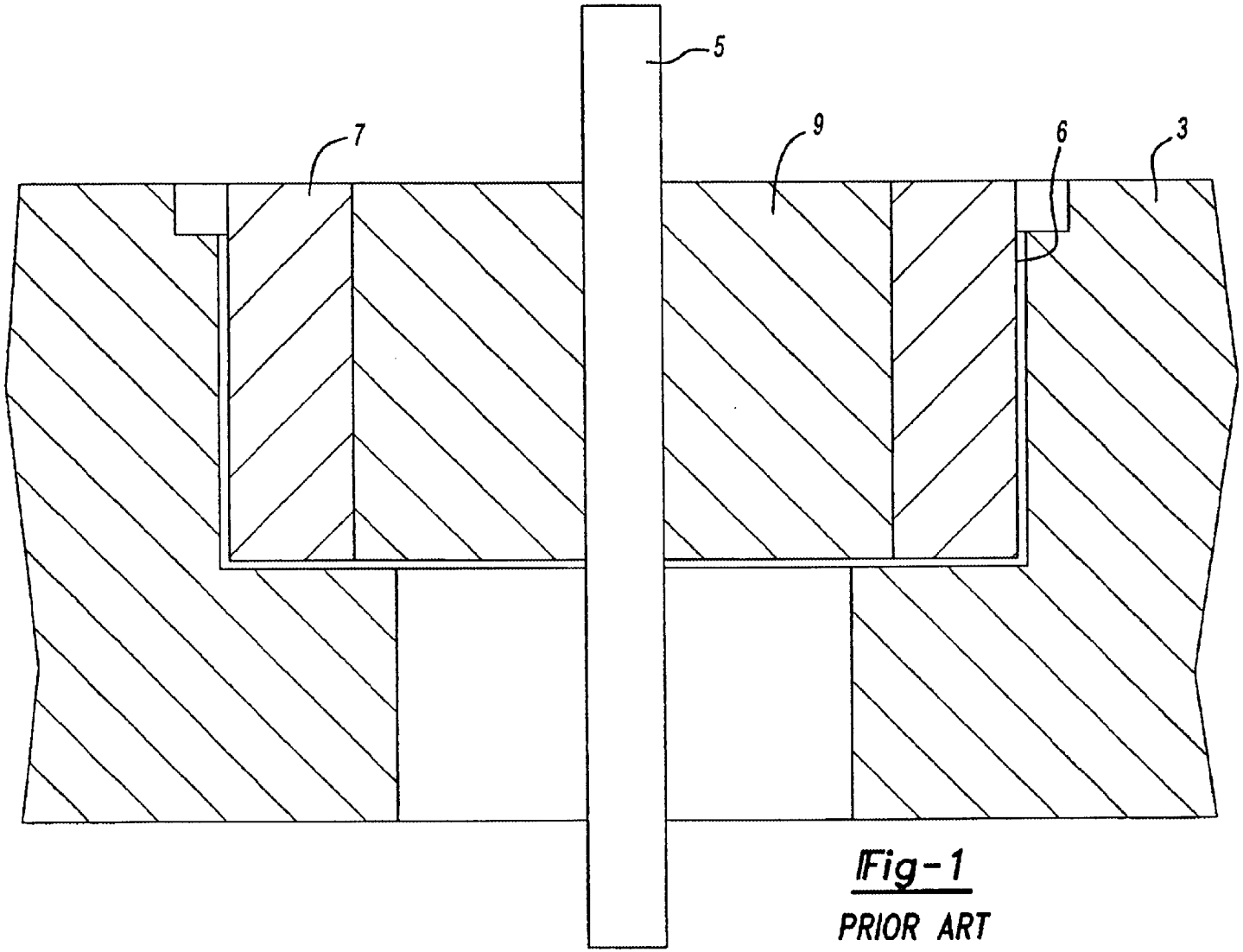
Fig-1 PRIOR ART
FIG. 1 is a cross-sectional front view of a prior art terminal installation showing an unprotected air path between a conductive pin and a wall.
Figure 2:
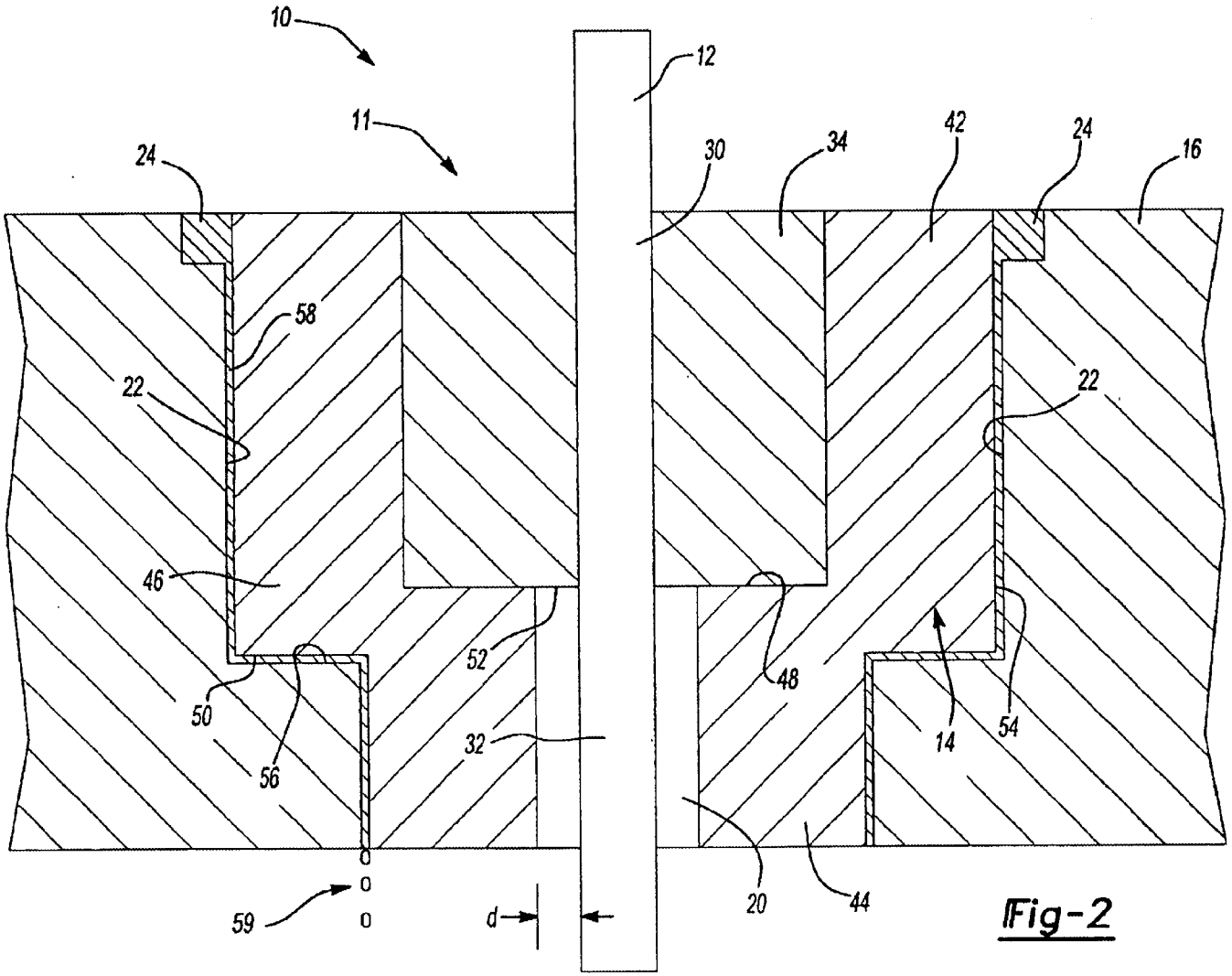
FIG. 2 is a cross-sectional front view an embodiment of a terminal installation according to the invention showing a protected air path between a conductive pin and a body having a shoulder.

FIG. 2 illustrates an embodiment of a terminal installation 10 according to the invention. A terminal assembly 11 is installed in an aperture 22 defined in a supporting structure (herein after "the wall") 16. The aperture 22 is adapted to receive the terminal assembly 11 using a joining process, such as, for example, brazing, soldering, adhesive bonding, etc., which fills the space between the aperture 22 and the terminal assembly 11 with a joining process material 58. The joining process material 58 may be a filler metal for soldering or brazing processes, or any type of adhesive, such as epoxy, for adhesive bonding. The terminal assembly 11 comprises a conductive pin 12 that has first and second portions 30, 32, a body 14 having an outer surface 54, and a dielectric seal 34. The body 14 includes first and second portions 42, 44.

The dielectric seal 34 is annular and encloses the first portion 30 of the conductive pin 12. The dielectric seal 34 may be made of a glass matrix composed chiefly of silicates and an alkali substance. It should be understood, however, that the glass matrix may include other substances such as, for example, oxides. The dielectric seal could also be made from other materials, including plastic, polymers, cured epoxy, etc.

The body 14 includes a shoulder 46 between the first and second portions 42, 44. The shoulder 46 may include an inner lip 48 and an outer lip 50. The dielectric seal 34 is disposed between the first portion 42 of the body 14 and the first portion 30 of the pin 12, and is partially seated on the inner lip 48 of the body 14, such that an inner annular portion 52 of dielectric seal 34 is not seated on the inner lip 48 of the body 14. The annular portion 52 creates a gap 20 having width "d" and providing an air path between the second portion 32 of the conductive pin 12 and the second portion 44 of the body 14 to allow an electric component (not shown) to be connected to the conductive pin 12. It should be understood that the magnitude of the width "d" is variable and may be modified according to the particular application for the terminal assembly.

The body 14 is made of a low expansion metal alloy, such as, for example, Kovar®. The body 14 and the dielectric seal 34 are sealed to each other using glass-to-metal sealing methods well known in the art. It should be understood that the body 14 may be made of any low expansion metal alloy that can be used in applications that require glass to metal sealing.

The aperture 22 in the wall 16 is adapted to receive the body 14 and join the body 14 to the wall 16. Therefore, the aperture 22 conforms with the outer surface 54 of the body 14, such that the aperture 22 includes a shoulder portion 56 corresponding to the shoulder 46 of the body 14. In one embodiment, the shoulder portion 56 of the aperture 22 may have a step that matches the outer lip 50 of the shoulder 46 of the body 14. The body 14 is secured to the aperture 22 using a joining process that fills the aperture 22 with joining process material 58, which may be, for example, solder. The joining process joins and secures the body 14 to the aperture 22 of the wall 16. In addition, a groove 24 may be defined at the uppermost portion of the aperture 22 between the wall 16 and the first portion 42 of the body 14. The groove 24 is also filled with the joining process material 58.

It will be appreciated that depending on the joining process used, the joining process material 58 may be injected into the aperture 22, inserted and heated until it flows to fill the space between the aperture 22 and the body 14, following the contours of the shoulder 46 of the body 14 and the shoulder portion 56 of the aperture 22. The joining process material 58 fills that space for the entire length of the aperture 22 and the groove 24. Any excess amount of the joining process material 58 flows parallel to the second portion 44 of the body 14, thereby eliminating the potential of debris 59 from joining process migrating into the gap and contaminating the conductive pin 12. The body 14 and the aperture 22 in the wall 16 are securely joined together, thereby completing the installation of the terminal assembly 11. It should be understood that the joining process material 58 that fills the aperture 22 may be any type of material capable of securing the body 14 in the aperture 22. The joining process and the joining process material 58 may also be selected to provide a hermetic seal between the body 14 and the wall 16.

The structure of the terminal assembly 11 of the present invention eliminates the potential of debris 59 from the joining process material 58 migrating toward and contaminating the conductive pin 12 during installation. In addition, the structure of the terminal assembly 11 can provide an effective hermetic seal between the body 14 and the aperture 22 in the wall 16, which will enable the terminal assembly 11 to withstand elevated stress and temperature conditions without experiencing breakage between the body 14 and the aperture 22.

While various embodiments of the invention have been described, it will be apparent to those of ordinary skill in the art that other embodiments and implementations are possible that are within the scope of this invention. Accordingly, the invention is not restricted except in light of the attached claims and their equivalents.

What is claimed is:

1. A terminal installation comprising:

a body comprising an outer surface, and a shoulder, the shoulder comprising an inner lip;

an aperture adapted to receive and join the body to a wall with a joining process material;

a current-conducting pin extending longitudinally through the body; and a dielectric seal between the body and a first portion of the pin, wherein the seal is partially seated on the inner lip of the shoulder.

2. The terminal installation of claim 1, further comprising a gap between a second portion of the pin, the body and the seal.

3. The terminal installation of claim 2, wherein the shoulder comprises an outer lip that prevents the migration of debris from the outer surface of the body to the gap and to second portion of the pin during installation.

4. The terminal installation of claim 3, wherein the debris comprise portions of joining process material.

5. The terminal installation of claim 3, wherein the outer lip is parallel to the inner lip.

6. The terminal installation of claim 5, wherein the outer lip is perpendicular to the longitudinal opening.

7. The terminal installation of claim 1, wherein the seal is a glass to metal seal.

8. The terminal installation of claim 1, wherein the aperture comprises a groove receiving joining process material.

9. The terminal installation of claim 1, wherein the shoulder is configured to prevent the migration of debris toward the pin during installation.

10. A terminal installation comprising:

a current-conducting pin comprising first and second portions;

a body having first and second portions corresponding to the first and second portions of the pin, wherein the first and second portions of the body are joined by a shoulder;

an aperture adapted to receive and join the body to a wall with a joining process material;

a dielectric seal between the first portion of the body and the first portion of the pin, wherein at least a portion of the seal is seated on the shoulder such that a gap is defined between the second portion of the body and the second portion of the pin.

11. The terminal installation of claim 10, wherein the aperture comprises a shoulder portion and the shoulder of the body comprises an outer lip, the combination directing any excess amount of a joining process material so as to avoid contamination of the second portion of the pin during installation.

12. The terminal installation of claim 10, wherein the shoulder comprises an inner lip on which at least a portion of the seal is seated, and an outer lip.

13. A terminal assembly comprising:

a body comprising an outer surface, a first portion and a second portion, and a shoulder disposed between the first and second portions, the shoulder comprising an inner lip;

a current-conducting pin extending through the body and comprising a first portion and a second portion each respectively corresponding to the first portion and the second portion of the body; and a dielectric seal disposed between the first portion of the body and the first portion of the pin, at least a portion of the dielectric seal being seated against the inner lip, the dielectric seal comprising an inner annular portion not seated against the inner lip that creates a gap between the second portion of the pin and the second portion of the body.

* * * * *